US008215412B2

(12) United States Patent
Williams et al.

(10) Patent No.: US 8,215,412 B2
(45) Date of Patent: Jul. 10, 2012

(54) FIRE FIGHTING METHOD AND APPARATUS DEPLOYED AFTER FLAME COLLAPSE FOR EXTINGUISHING "SMILEY FACE"

(75) Inventors: Dwight P. Williams, Vidor, TX (US); Douglas A. Daspit, Vidor, TX (US)

(73) Assignee: Willfire HC, LLC, Mansfield, TX (US)

( * ) Notice: Subject to any disclaimer, the term of this patent is extended or adjusted under 35 U.S.C. 154(b) by 1258 days.

(21) Appl. No.: 10/147,647

(22) Filed: May 16, 2002

(65) Prior Publication Data

US 2003/0213602 A1 Nov. 20, 2003

(51) Int. Cl.
*A62C 3/06* (2006.01)

(52) U.S. Cl. ..... 169/47; 169/66; 239/279

(58) Field of Classification Search ..... 169/46, 169/47, 54, 64, 65, 66; 239/279
See application file for complete search history.

(56) References Cited

U.S. PATENT DOCUMENTS

| | | | | | |
|---|---|---|---|---|---|
| 1,775,846 | A | * | 9/1930 | Blaw | 169/67 |
| 3,741,309 | A | * | 6/1973 | McCulloch | 169/59 |
| 3,866,687 | A | | 2/1975 | Banner | |
| 4,674,686 | A | * | 6/1987 | Trapp | 239/279 |
| 4,781,252 | A | | 11/1988 | Wilburn | |
| 5,240,078 | A | * | 8/1993 | Worthington | 169/47 |
| 5,566,766 | A | * | 10/1996 | Williams | 169/43 |
| 5,829,533 | A | * | 11/1998 | Williams | 169/46 |
| 5,913,366 | A | * | 6/1999 | Williams et al. | 169/46 |

FOREIGN PATENT DOCUMENTS

WO WO 98/03226 1/1998

* cited by examiner

*Primary Examiner* — Christopher Kim
(74) *Attorney, Agent, or Firm* — Sue Z. Shaper

(57) ABSTRACT

Method and apparatus for extinguishing industrial tank fires of flammable/combustible liquid including achieving flame collapse, and subsequent to flame collapse achieving collapse of a remaining "smiley face".

6 Claims, 2 Drawing Sheets

FIRE FIGHTING METHOD AND APPARATUS DEPLOYED AFTER FLAME COLLAPSE FOR EXTINGUISHING "SMILEY FACE"

The instant invention is related to a throw-down type Daspit tool, which is taught and disclosed in copending U.S. Ser. No. 09/569,178. This referenced application is incorporated herein by reference in its entirety.

This invention also relates to and is an improvement to three of my prior patents, U.S. Pat. Nos. 5,556,766; 5,913,366; and 5,829,533. The above three patents are also herein incorporated by reference in their entirety.

BACKGROUND OF THE INVENTION

The phrase "primary nozzle" is selected herein to indicate a nozzle used to achieve or help achieve flame collapse. Primary nozzles throw large gpm's of foam. A primary nozzle creates a primary stream. In the footprint system, primary streams are generally applied to a tank parallel.

Absent unusual circumstances, in the footprint system primary nozzle(s) is/are staged "upwind" of a tank to create stream(s) generally aligned with the wind. If the surface of a tank is viewed as a clock, the location vis-a vis the tank where the primary nozzle(s) is/are staged, again which is usually upwind of the tank, is helpfully referred to as the six o'clock position. The general direction across the tank from where the primary nozzle(s) is/are staged, again usually the down wind position, is then referred to as the twelve o'clock position. The three o'clock and the nine o'clock positions follow therefrom.

Streams defined by primary nozzles need not rigorously parallel the wind direction and each other; however, in the footprint system their streams would usually not define an angle more than plus or minus 45° with the wind direction or with each other.

The phrase "flame collapse" is used herein to indicate a laying down of at least 50% of the flame. The phrase "preferred flame collapse" is used to indicate a laying down of at least 80% of the flame. Flame collapse in industrial tank fires is typically achieved by blanketing at least a substantial surface area of a tank with foam.

It has been discovered in large tanks, such as tanks of 200-foot diameter or greater, that flame collapse (and preferred flame collapse) can usually be achieved by staging one or more primary nozzles such that they create adequate footprint(s) of foam on the tank surface such that the foam "run" blankets the surface. Subsequent to flame collapse (and/or preferred flame collapse,) however, a "smiley face" frequently remains. The phrase "smiley face" refers to a condition in the tank where flames remain, after initial flame collapse, proximate to inner wall portions closest to the staging area, or generally in the four o'clock to eight o'clock position.

SUMMARY OF THE INVENTION

The instant invention discloses a technique for effectively and efficiently achieving full flame collapse by, subsequent to establishing an initial flame collapse (preferably subsequent to establishing a preferred flame collapse,) treating a remaining "smiley face" by using appropriately staged react line(s) and nozzle(s).

Preferably, a react line and nozzle is not laid until the establishment of initial flame collapse (or preferred flame collapse). Then, at least one, and preferably at least two, react lines and nozzles are laid around the periphery of the tank, typically within 80 to 100 feet from the tank. Preferably a first react line and nozzle is staged at approximately the three o'clock position and generates a stream that delivers foam over a tank wall toward inner wall portions at approximately the five o'clock position. Likewise, a second react line and nozzle is staged at approximately the nine o'clock position and delivers foam over a tank wall toward inner tank wall portions at approximately the seven o'clock position. (A tank wall is approximately 50 feet high.)

It might be noted that the foam thus delivered by a react line is fresh, relatively non-dehydrated foam. Its cooling potential is greater than that of the older foam of an existing blanket, which tends to have become dehydrated with time and run.

React lines and nozzles preferably have a capacity of 1000 to 1500 or 2000 gpm while primary nozzles typically have a larger capacity. For instance, the capacity of a pair of primary nozzles might be 5000 gpm each.

A preferred apparatus for use with a react line and nozzle includes a throw-down Daspit tool or frame. Such tool or frame is disclosed in particular in the related US application incorporated herein by reference.

BRIEF DESCRIPTION OF THE DRAWINGS

A better understanding of the present invention can be obtained when the following detailed description of the preferred embodiments are considered in conjunction with the following drawings, in which:

FIG. 1A indicates location of primary nozzles for a primary attack and react lines with react nozzles; FIG. 1B selectively illustrates a preferred attack on a "smiley face".

DETAILED DESCRIPTION OF PREFERRED EMBODIMENTS

Figure 1A:
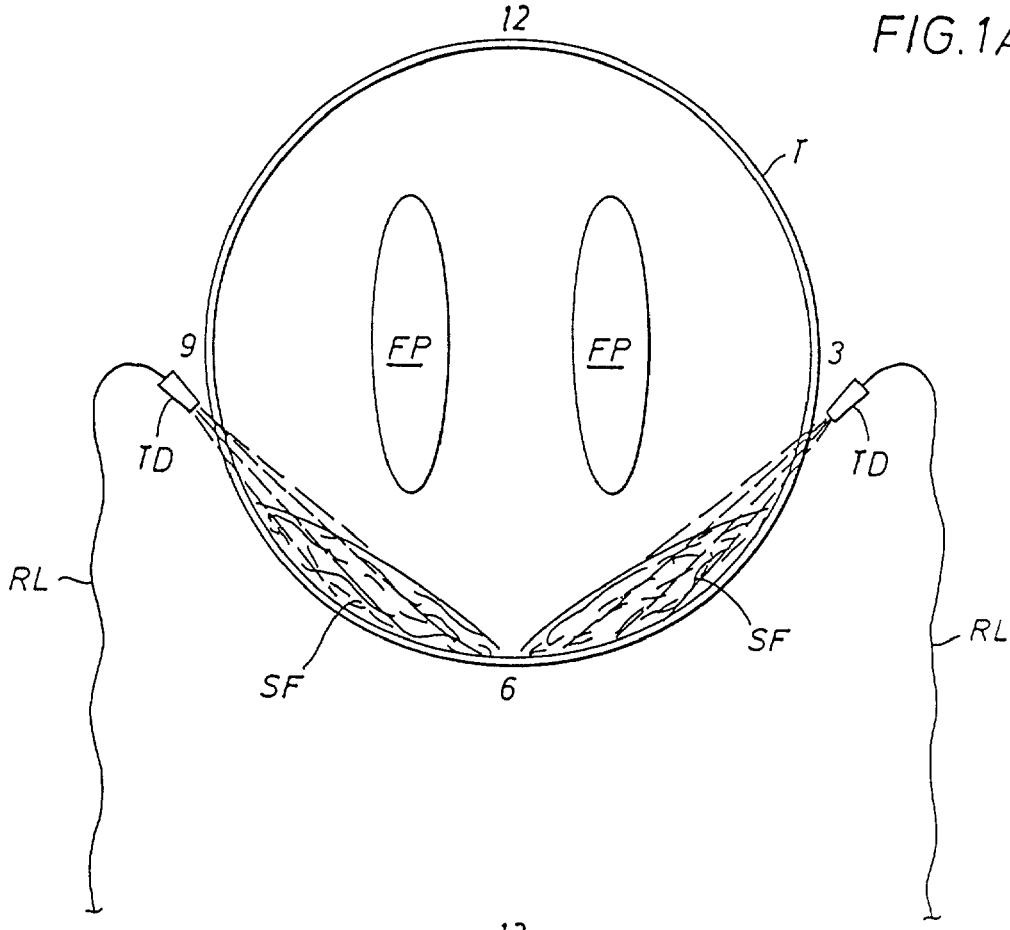
FIGS. 1A and 1B illustrate schematically a clockface on a tank, together with the location of a "smiley face"
Figure 1B:
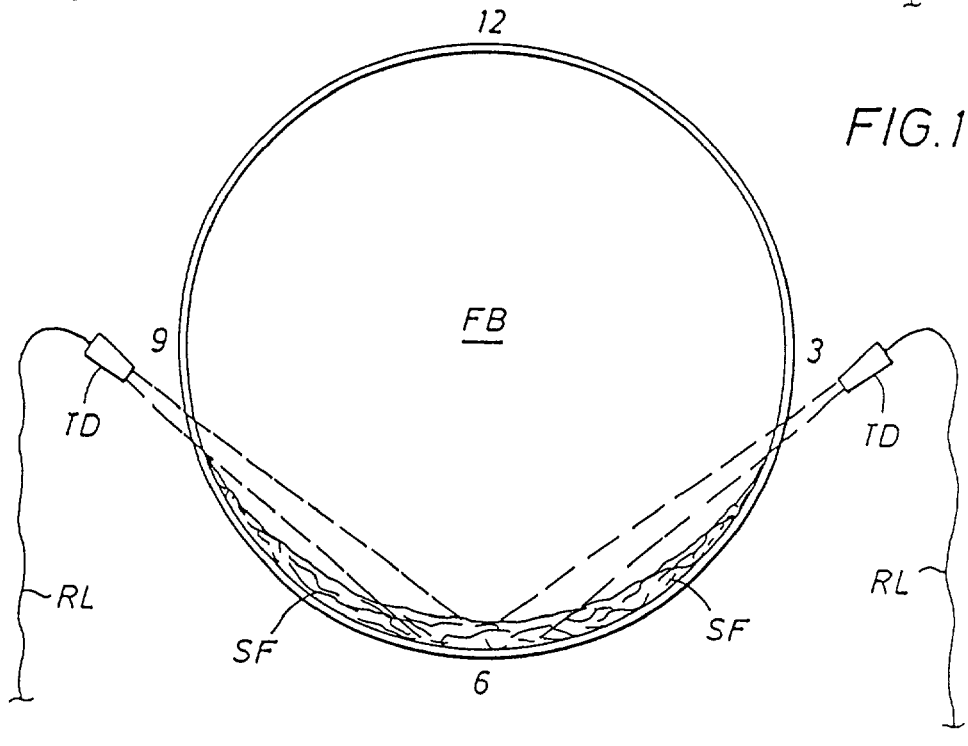

FIGS. 1A and 1B illustrate definitional features of the instant invention. Two footprints FP on the liquid surface of tank T are shown in FIG. 1A. These are footprints thrown from two primary nozzles, illustrated as 5000 gpm each, staged at six o'clock with respect to tank T. The foam "run" from these footprints is calculated to reach the tank walls. Two portions of a "smiley face" SF are shown, extending roughly from eight o'clock to six o'clock and four o'clock to six o'clock, in FIGS. 1A and 1B. React lines RL and Daspit tools TD are shown located with respect to tank T. FIGS. 1A and 1B illustrate by arrows the direction of the forward streams of the react lines and react nozzles, illustrating that they create a greater than 90° included angle IA with the direction of forward segments of the streams from the primary nozzles.

Figure 2:
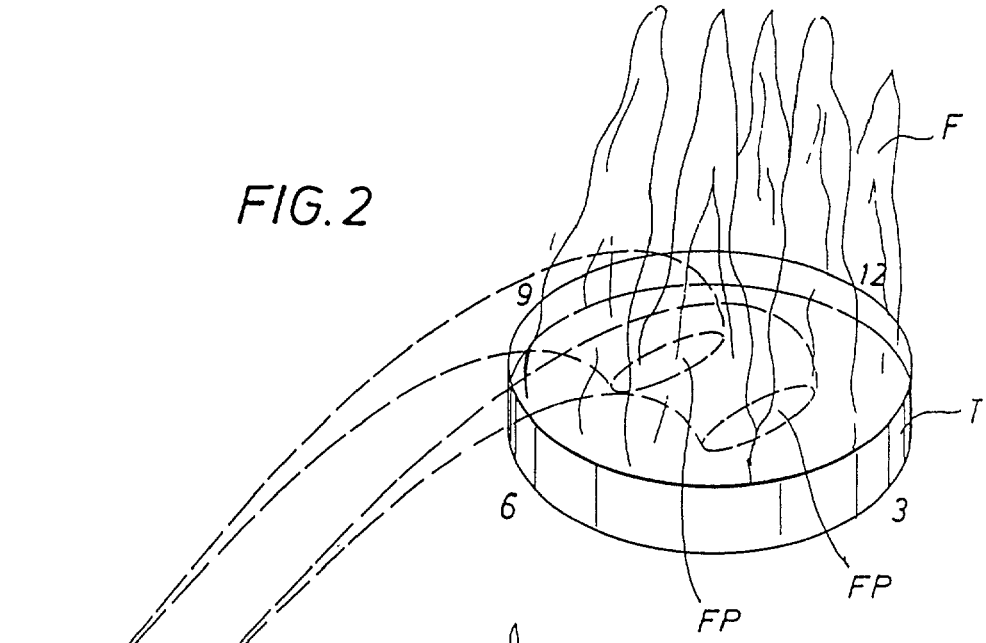
FIG. 2 illustrates a tank fully engaged prior to flame collapse, together with primary nozzles staged for a primary attack.
Figure 3:
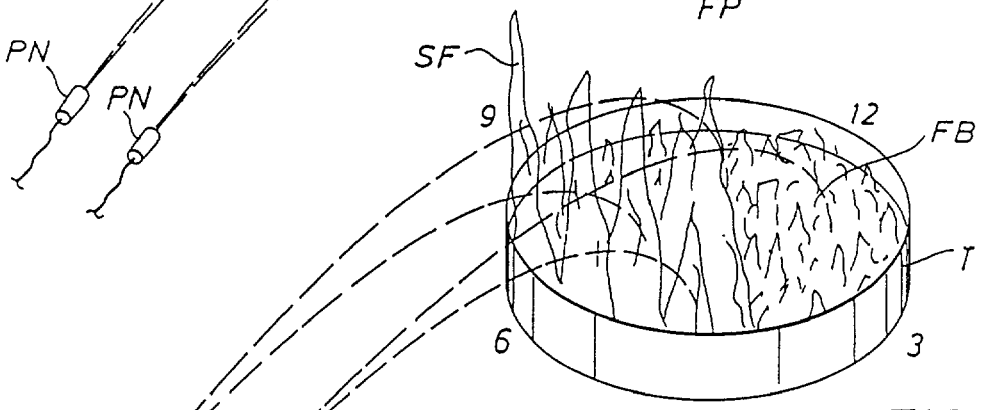
FIG. 3 illustrates a tank after flame collapse, including preferred flame collapse, with a "smiley face".
Figure 4:
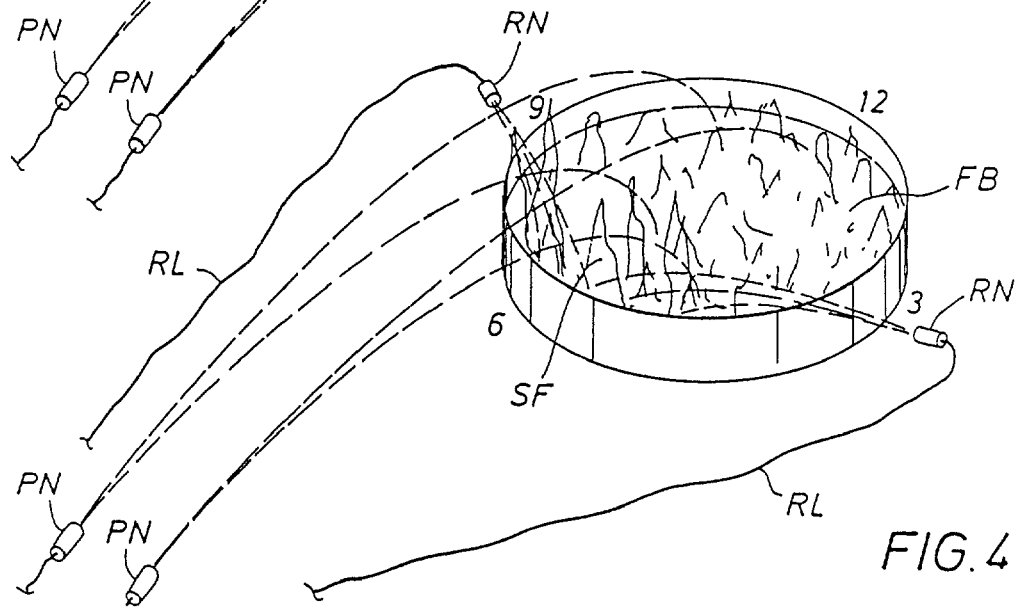
FIG. 4 illustrates the attack with react line and react nozzles on the "smiley face".

FIGS. 2, 3 and 4 further illustrate the method of the instant invention. FIG. 2 illustrates that in an attack on a fully engaged tank fire, illustrated in FIG. 2 by tank T with flame F, an attack to achieve flame collapse using the footprint system would be mounted preferably by primary nozzles PN staged in the upwind direction of tank T. (Of course, there may be unusual circumstances such as changing or variable winds, or no wind, or other considerations or structures that require the primary attack to be staged from a location not directly upwind. However, considerations of safety, efficiency and cost-effectiveness recommend the upwind direction as the location for staging the primary nozzles to achieve flame collapse, absent any overriding considerations.)

For ease of reference, in the field as well as herein, the tank is labeled in accordance with a clock face. The six o'clock direction is the area of the tank wall nearest the staging area of the primary nozzles. Of course, the primary nozzles themselves will be spread somewhat apart. However, their general location can be referred to as the six o'clock position vis a vis the tank. The direction around the tank furthest from or opposite from the general staging area of the primary nozzles is labeled twelve o'clock, which is usually the downwind position. The primary nozzle(s), their staging, flow rate and foam type is/are selected to generate footprint(s) FP of foam on the liquid surface of the tank calculated to run to the tank walls to blanket the surface of the tank with a layer of foam. A sufficient layer of foam should achieve flame collapse, preferably preferred flame collapse.

FIG. 2 illustrates footprints FP indicating essential landing areas of the foam from illustrated nozzles PN. (Of course, it should be realized that other nozzles may be around the tank, performing other functions such as wall cooling, etc. The nozzles referred to herein as the primary nozzle or nozzles are the nozzles primarily relied upon to achieve flame collapse. These nozzles are generally staged in the six o'clock location.) Foam run from the landing footprint(s) FP carries the foam to the walls of the tank and creates a foam blanket FB thereon, thereby achieving flame collapse. However, the foam blanket, at least initially, is frequently not complete.

Foam run is the weakest in the reverse direction. The reverse direction is the direction from the center of the tank back towards six o'clock. The reverse direction is typically against the wind and against the direction of the velocity of throw of the nozzles. As a result, as illustrated in FIG. 3, after foam blanket FB achieves flame collapse, and preferably preferred flame collapse, there is typically remaining generally a "smiley face" of flame. The "smiley face" exists around inside wall portions of the tank generally in the six o'clock direction. Typically, the "smiley face" extends from approximately the four o'clock position to the eight o'clock position. See FIG. 1B.

In order to efficiently and cost effectively collapse the "smiley face", the instant invention teaches also laying react lines RL and react line nozzles RN. Typically react line nozzles RN will not have as large a gallonage of flow as the primary nozzle(s). For instance, if the primary nozzles each flow 5000 gpm, each react line nozzle might flow 1000 to 1500 or 2000 gpm. Preferably, two react lines and two react nozzles are laid at the three o'clock and nine o'clock positions. The react line nozzle at the three o'clock position is typically staged 80 to 100 feet away from the side of the tank. From such position an appropriate nozzle can throw foam over the wall of the tank (usually about 50 feet high) and into approximately the five o'clock position near the inside of the wall. The react nozzle staged at the nine o'clock position, preferably 80 to 90 feet away from the wall of the tank, should be capable of throwing foam over the wall of the tank and into the seven o'clock position near the inside wall of the tank. The foam from the react line nozzles falling at the five o'clock and the seven o'clock position should suffice to cost effectively extinguish the "smiley face" to speed complete flame collapse.

Preferably, the react lines would not be laid until after flame collapse, and preferably preferred flame collapse, is achieved, because flame collapse or preferred flame collapse would allow a closer and more comfortable approach to the walls of the tank. The react line nozzles are preferably anchored with a throw down type Daspit tool or frame, such as utilizing the Daspit tool and frame illustrated in the above referenced application, in particular the frame of FIG. 7.

By such technique essentially complete flame collapse can be achieved in a timely and cost-effective manner.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below.

What is claimed is:

1. A method for extinguishing industrial tank fires of flammable/combustible liquid, comprising;

achieving flame collapse leaving a "smiley face", the achieving including applying foam over a tank wall with one or more primary nozzles staged at a six o'clock position and collapsing flame against furthest tank wall portions opposite the six o'clock position;

subsequent to said flame collapse, achieving collapse of the "smiley face", the achieving collapse of the "smiley face" including applying foam over a tank wall to the "smiley face" using at least one react line and nozzle staged at least at an eight o'clock or further away position, or four o'clock or further away position, around the tank from the six o'clock position;

the applying foam including attaching the react line to a portable wall-attachable fire fighting apparatus including a portable base and monitor combination for the nozzle, the combination structured to provide at least two degrees of freedom, to throw a stream of foam at positive angles of inclination, to provide at least a 100 foot lateral range and flow at least 1000 gpm, the wall-attachable apparatus structured to securely encompassment and attach to wall rim portions of variable widths.

2. The method of claim 1 wherein the wall rim portions of variable widths include a vertical plate of a portable frame, the frame structured either to attach to a pickup truck bed or to locate on ground, and wherein an angle between a forward segment of a react line stream and a forward segment of a primary stream is at least 45 degrees.

3. The method of claim 1 wherein the wall rim portions of variable widths include a vertical plate attached to a portable frame structured to locate on the ground, the frame having legs structured to attach to hose to provide ballast for the frame, and including laying the react line, at least in part, subsequent to achieving flame collapse.

4. The method of claim 1, 2 or 3 wherein achieving flame collapse includes achieving preferred flame collapse.

5. The method of claim 1 wherein two react line nozzles are staged at approximately the three o'clock and the nine o'clock positions.

6. The method of claim 5 including staging a react line nozzle at three o'clock and aiming its stream over the tank wall toward an inner wall five o'clock position, and staging a react line nozzle at nine o'clock and aiming its stream over the tank wall toward an inner wall seven o'clock position.

* * * * *